US009474141B1

(12) United States Patent
Hong et al.

(10) Patent No.: US 9,474,141 B1
(45) Date of Patent: Oct. 18, 2016

(54) ARC ATMOSPHERIC PRESSURE PLASMA DEVICE

(71) Applicant: CREATING NANO TECHNOLOGIES, INC., Tainan (TW)

(72) Inventors: Chau-Nan Hong, Tainan (TW); Yi-Ming Hsu, Tainan (TW); Li-Min Wang, Tainan (TW)

(73) Assignee: CREATING NANO TECHNOLOGIES, INC., Tainan (TW)

( * ) Notice: Subject to any disclaimer, the term of this patent is extended or adjusted under 35 U.S.C. 154(b) by 0 days.

(21) Appl. No.: 14/989,809

(22) Filed: Jan. 7, 2016

(30) Foreign Application Priority Data

Aug. 25, 2015 (TW) ..... 104127701 A

(51) Int. Cl.

| | |
|---|---|
| ***H05H 1/40*** | (2006.01) |
| ***H05H 1/36*** | (2006.01) |
| ***H05H 1/34*** | (2006.01) |
| ***H05H 1/48*** | (2006.01) |
| *H05H 1/24* | (2006.01) |

(52) U.S. Cl.
CPC ..... *H05H 1/36* (2013.01); *H05H 1/34* (2013.01); *H05H 1/48* (2013.01); *H05H 1/24* (2013.01)

(58) Field of Classification Search
CPC ..... H05H 1/48; H05H 1/24
USPC ..... 315/111.21, 111.11, 111.71, 111.01, 315/111.61
See application file for complete search history.

(56) References Cited

U.S. PATENT DOCUMENTS

| | | | | |
|---|---|---|---|---|
| 6,262,386 | B1 * | 7/2001 | Fornsel | H05H 1/34 219/121.39 |
| 2002/0002982 | A1 * | 1/2002 | Fornsel | B08B 7/0035 134/1.1 |
| 2002/0179575 | A1 * | 12/2002 | Fornsel | H05H 1/34 219/121.5 |
| 2004/0045319 | A1 * | 3/2004 | Schussler | C03B 23/043 65/34 |
| 2008/0257379 | A1 * | 10/2008 | Buske | H05H 1/34 134/1.1 |
| 2010/0021340 | A1 * | 1/2010 | Buske | A61L 2/14 422/28 |

* cited by examiner

*Primary Examiner* — Tuyet Vo
(74) *Attorney, Agent, or Firm* — CKC & Partners Co., Ltd.

(57) ABSTRACT

An arc atmospheric pressure plasma device is described. The arc atmospheric pressure plasma device includes a first electrode, a second electrode and a nozzle. The first electrode is configured to connect to a power supply. The second electrode has a chamber and is grounded. The first electrode is located within the chamber. The nozzle is connected to a bottom of the second electrode, and has at least two nozzle channels. The nozzle channels communicate with the chamber.

10 Claims, 5 Drawing Sheets

ARC ATMOSPHERIC PRESSURE PLASMA DEVICE

RELATED APPLICATIONS

This application claims priority to Taiwan Application Serial Number 104127701, filed Aug. 25, 2015, which is herein incorporated by reference.

BACKGROUND

1. Field of Invention

The present invention relates to a plasma device. More particularly, the present invention relates to an arc atmospheric pressure plasma device.

2. Description of Related Art

Currently, atmospheric pressure plasma has been widely applied on surface treatments in various fields, so as to increase reliability of processes, such as adhesion, printing, package and bonding processes. However, because an arc of the arc atmospheric pressure plasma has a negative resistance property, an arc discharge with a large area cannot be generated, thus a treating range of the arc atmospheric pressure plasma is limited, and an application of the arc atmospheric pressure plasma is limited.

Although the arc atmospheric pressure plasma cannot generate arc discharge with a large area, the arc atmospheric pressure plasma has a higher discharge density and can generate more active substances, thus the arc atmospheric pressure plasma has a faster treating speed. Therefore, a surface treatment of an object can be completed by performing a short time contact by scanning operation with the arc atmospheric pressure plasma, thereby enhancing the application of the arc atmospheric pressure plasma.

Currently, a technique that slants and rotates a nozzle of an arc plasma device is provided. With the design, when the plasma is ejected from the nozzle, a spraying area of the plasma is enlarged because of the slanting and the circular rotating of the nozzle. A large area treatment effect can be achieved by removing a treated object. However, in this technique, there are many disadvantages resulted from rotating the nozzle which is one of the electrodes. For example, as shown in FIG. 1, when a scanning speed of the plasma is too fast, and the rotating speed of the plasma nozzle cannot keep up with the scanning speed, a treatment path 100 of the plasma cannot completely cover a treated surface 102. Thus, a plasma treatment is non-uniform, and reliability and quality of the treatment are poor.

SUMMARY

Therefore, one objective of the present invention is to provide an arc atmospheric pressure plasma device, in which a plasma nozzle includes at least two nozzle channels, such that an ejected amount of plasma is increased, and a plasma treatment path becomes denser. Thus, a treatment area of a plasma scanning operation can be increased, thereby effectively improving uniformity of treatment compared to a rotation nozzle with one single nozzle channel.

Another objective of the present invention is to provide an arc atmospheric pressure plasma device, in which the nozzle with a multi-channel design blocks the arc and then only plasma is ejected from the nozzle channels, thereby preventing a treated surface from be damaged due to a direct hit of the arc, so as to enhance uniformity and quality of the plasma treatment.

According to the aforementioned objectives, the present invention provides an arc atmospheric pressure plasma device. The arc atmospheric pressure plasma device includes a first electrode, a second electrode and a nozzle. The first electrode is configured to connect to a power supply. The second electrode has a chamber and is grounded, in which the first electrode is located within the chamber. The nozzle is connected to a bottom of the second electrode, and has at least two nozzle channels. The nozzle channels communicate with the chamber.

According to one embodiment of the present invention, a central axis of each of the nozzle channels is parallel to a central axis of the chamber.

According to another embodiment of the present invention, an included angle is formed between a central axis of each of the nozzle channels and a central axis of the chamber.

According to still another embodiment of the present invention, a central axis of at least one of the nozzle channels is parallel to a central axis of the chamber, and an included angle is formed between a central axis of at least the other one of the nozzle channels and the central axis of the chamber.

According to further another embodiment of the present invention, an outlet of each of the nozzle channels is in a circle shape, an ellipse shape, a slit shape or a polygon shape.

According to still further another embodiment of the present invention, the second electrode is a rotation electrode which rotates by using a central axis of the chamber as a rotation axis.

According to still further another embodiment of the present invention, a material of the nozzle is metal or a combination of metal and ceramics.

According to still further another embodiment of the present invention, sizes of the nozzle channels are different.

According to still further another embodiment of the present invention, sizes of the nozzle channels are substantially the same.

According to still further another embodiment of the present invention, an output frequency of the power supply ranges from 1 kHz to 60 kHz, and a voltage of the power supply ranges from 5 kV to 20 kV.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
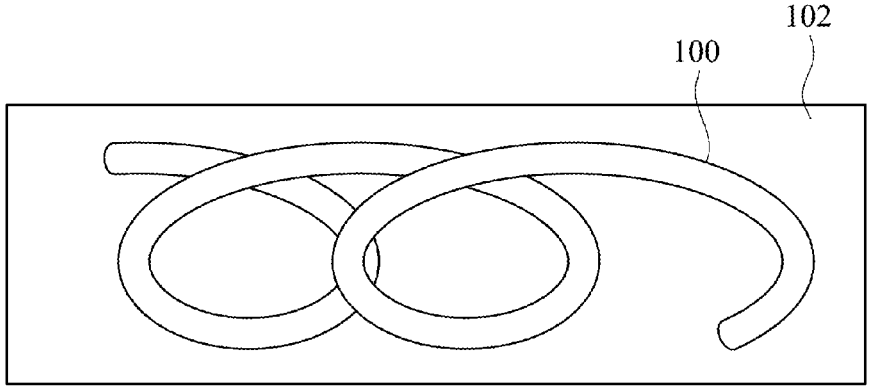
FIG. 1 (PRIOR ART)
FIG. 1 is a schematic drawing of a plasma treatment path on a treated surface which is treated by a conventional plasma device.
Figure 2:
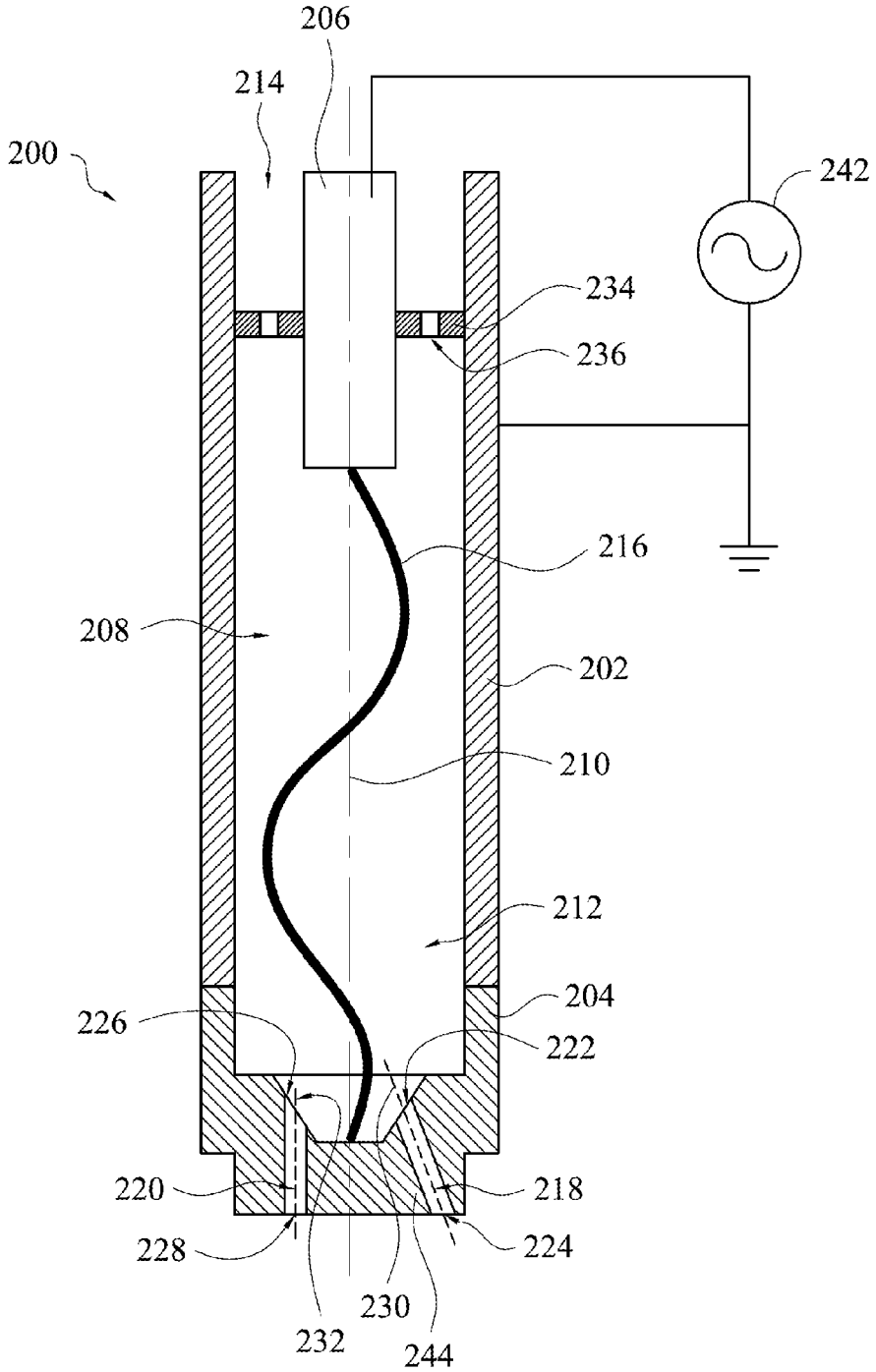
FIG. 2 is schematic drawing of an arc atmospheric pressure plasma device in accordance with one embodiment of the present invention.

Referring to FIG. 2, FIG. 2 is schematic drawing of an arc atmospheric pressure plasma device in accordance with one embodiment of the present invention. In some examples, an arc atmospheric pressure plasma device 200 mainly includes a first electrode 206, a nozzle 204 and a second electrode 202. The first electrode 206 is configured to connect to a power supply 242. The first electrode 206 may be, for example, a rod electrode, as shown in FIG. 2. The first electrode 206 may be a hollow electrode. In some examples, the power supply 242 is a high frequency and high voltage power supply. In some exemplary examples, an output frequency of the power supply 242 ranges from 1 kHz to 60 kHz, and a voltage of the power supply 242 ranges from 5 kV to 20 kV.

The second electrode 202 may be a tubular electrode and have a chamber 208. The second electrode 202 is grounded. In addition, the second electrode 202 has openings 212 and 214, which are respectively disposed at two opposite ends of the second electrode 202. A working gas can be introduced into the chamber 208 from the opening 214 of the second electrode 202. The chamber 208 has a central axis 210. The first electrode 206 is disposed within the chamber 208 of the second electrode 202 and adjacent to the opening 214. The first electrode 206 can generate an arc 216 passing through the chamber 208. With the discharging of the arc 216, the working gas within the chamber 208 breaks down and is ionized to form plasma.

In some examples, the second electrode 202 is a rotation electrode which rotates by using the central axis 210 of the chamber 208 as a rotation axis. For example, the second electrode 202 may be fixed to a rotation bearing (not shown), and the rotation bearing may be connected to an external power source. The second electrode 202 can be rotated by using the external power source to rotate the rotation bearing, such that the second electrode 202 rotates by using the central axis 210 of the chamber 208 as a rotation axis. In some other examples, the second electrode 202 is a fixed electrode and cannot rotate.

In some exemplary examples, as shown in FIG. 2, the arc atmospheric pressure plasma device 200 may optionally include a flat plate 234. The flat plate 234 is adjacent to the opening 214 of the second electrode 202 for fixing the first electrode 206 within the chamber 208. In some examples, the flat plate 234 has various holes 236, in which the working gas can pass through the holes 236 to a reaction region of the chamber 208 under the flat plate 234. In some exemplary examples, a major constituent of the working gas is air or nitrogen.

The nozzle 204 is disposed at the opening 212 of the second electrode 202 and is connected to a bottom of the second electrode 202. That is, the nozzle 204 is disposed at one side of the second electrode 202, and the first electrode 206 is disposed at the other side of the second electrode 202 which is opposite to the nozzle 204, such that the nozzle 204 and the first electrode are opposite to each other. The nozzle 204 has at least two nozzle channels, such as nozzle channels 218 and 220 shown in FIG. 2. Both the nozzle channels 218 and 220 communicate with the chamber 208 of the second electrode 202. The nozzle channel 218 has an inlet 222 and an outlet 224, and the nozzle channel 220 has an inlet 226 and an outlet 228. The plasma generated by the arc 216 passes through the chamber 208 firstly, and then enters the nozzle channels 218 and 220 through the inlets 222 and 226, and are ejected from the outlets 224 and 228 respectively.

In some examples, a material of the nozzle 204 may be metal, for example. In some certain examples, the nozzle 204 may be composed of metal and an insulating material, such as ceramics. For example, a portion 244 of the nozzle 204 which is located between the nozzle channels 218 and 220, and/or portions of the nozzle 204 which are adjacent to the nozzle channels 218 and 220 may be composed of an insulating material, such as ceramics. Portions of the nozzle 204 which are connected to the second electrode 202 may be composed of a metal material. When the portions 244 of the nozzle 204, which is located between the nozzle channels 218 and 220, is insulated, the arc 216 generated by the first electrode 206 passes through the chamber 208 and rotates over the portion 244 of the nozzle 204, such that plasma gas flow ejected from the nozzle 204 is more uniform. When the portion 244 of the nozzle 204 is insulated, it can prevent the portion 244 from being hit by the arc 216, such that a service life of the nozzle 204 can be effectively prolonged.

Furthermore, the nozzle channel 218 has a central axis 230, and the nozzle channel 220 has a central axis 232. In some examples, both the central axis 230 of the nozzle channel 218 and the central axis 232 of the nozzle channel 220 are not coaxial with the central axis 210 of the chamber 208. In some examples, the central axis of at least one of the nozzle channels 218 and 220 is parallel to the central axis 210 of the chamber 208, and an included angle is formed between the central axis of the other one of the nozzle channels 218 and 220 and the central axis 210 of the chamber 208, such that the central axis of the other one of the nozzle channels 218 and 220 is not parallel to the central axis 210 of the chamber 208. For example, as shown in FIG. 2, the central axis 230 of the nozzle channel 218 is not parallel to the central axis 210 of the chamber 208, and the central axis 230 of the nozzle channel 218 inclines to the central axis 210 of the chamber 208 at an angle, i.e. the an included angle is formed between the central axis 230 of the nozzle channel 218 and the central axis 210 of the chamber 208, such that the plasma can be ejected obliquely. On the other hand, the central axis 232 of the nozzle channel 220 is parallel to the central axis 210 of the chamber 208, such that the plasma can be ejected vertically. In some exemplary examples, the included angle between the central axis 230 of the nozzle channel 218 and the central axis 210 of the chamber 208 is greater than 0 degree and smaller than or equal to 90 degrees.

In some examples, each of the central axis 230 of the nozzle channel 218 and the central axis 232 of the nozzle channel 220 of the nozzle 204 is not parallel to the central axis 210 of the chamber 208, and inclines to the central axis 210 of the chamber 208 at an angle. The inclined angles of the nozzle channels 218 and 220 may be the same, or may be different. In some certain examples, both the central axis 230 of the nozzle channel 218 and the central axis 232 of the nozzle channel 220 are parallel to the central axis 210 of the chamber 208, such that the plasma can be ejected vertically.

Figure 3:
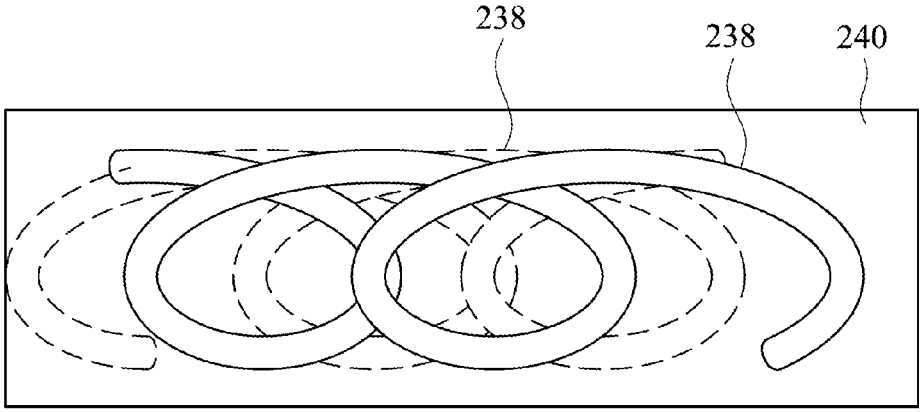
FIG. 3 is a schematic drawing of a plasma treatment path on a treated surface which is treated by an arc atmospheric pressure plasma device in accordance with one embodiment of the present invention.

With a multi-channel design of the nozzle 204, the arc 216 can be firstly blocked by the main body of the nozzle 204 and then only plasma can be ejected through the nozzle channels 218 and 220. Thus, it can prevent a treated surface from being locally damaged due to a direct hit by the arc 216, thereby enhancing uniformity and quality of the plasma treatment. In addition, as shown in FIG. 3, because the nozzle 204 includes the nozzle channels 218 and 220, an amount of plasma ejected by the arc atmospheric pressure plasma device 200 is greatly increased. Thus, a treatment path 238 of the plasma on a treated surface 240 is denser, thereby enhancing uniformity of the plasma treatment.

In addition, sizes of the nozzle channels 218 and 220, such as channel diameters, may be the same. But, in some examples, the sizes of the nozzle channels 218 and 220 may be different from each other. In some examples that a nozzle has three or more than three nozzle channels, sizes of the nozzle channels may be different from each other, or may be all the same, or may be partly the same. The nozzle channels 218 and 220 may be arranged in the nozzle 204 uniformly. In some examples, the nozzle channels 218 and 220 may be arranged in the nozzle 204 non-uniformly. In addition, each of the outlet 224 of the nozzle channel 218 and the outlet 228 of the nozzle channel 220 may be in any shape, such as a circle shape, an ellipse shape, a slit shape or a polygon shape. With a design of forming an outlet being in an elongated shape, such as a slit shape, a range of the plasma ejected from the nozzle channels 218 and 220 can be enlarged.

Figure 4A:
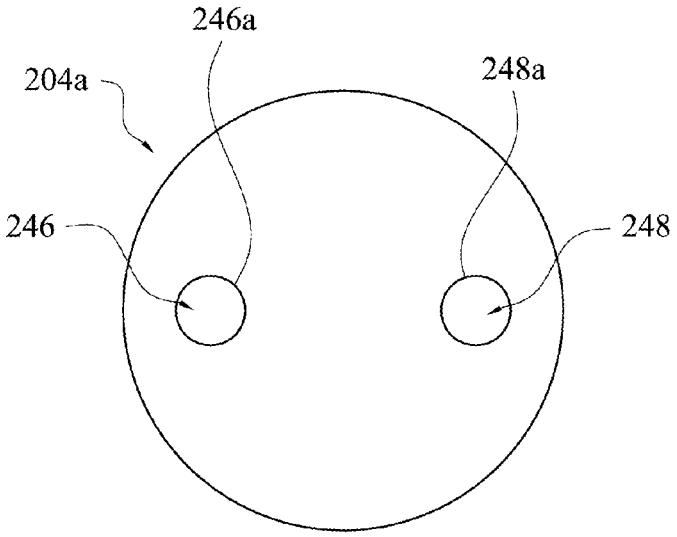
FIG. 4A is schematic drawing of outlets of a nozzle of an arc atmospheric pressure plasma device in accordance with a first embodiment of the present invention.
Figure 4B:
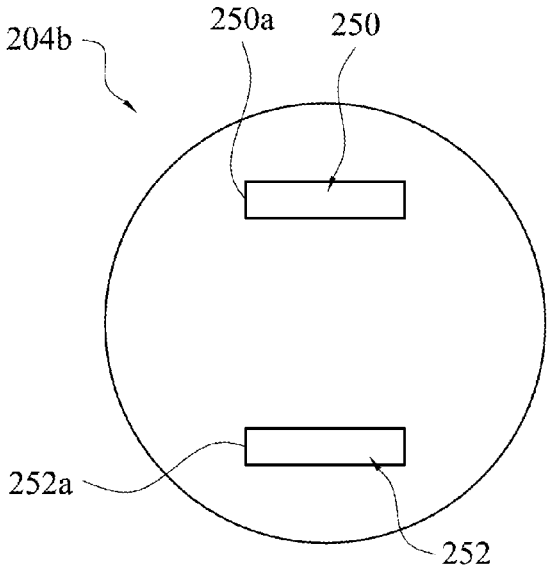
FIG. 4B is schematic drawing of outlets of a nozzle of an arc atmospheric pressure plasma device in accordance with a second embodiment of the present invention.

Referring to FIG. 4A to FIG. 4D, FIG. 4A to FIG. 4D are schematic drawings of outlets of a nozzle of an arc atmospheric pressure plasma device in accordance with four embodiments of the present invention respectively. As shown in FIG. 4A, a nozzle 204*a* has two nozzle channels 246 and 248. An outlet 246*a* of the nozzle channel 246 and an outlet 248*a* of the nozzle channel 248 are in circle shapes. In addition, sizes of the outlet 246*a* of the nozzle channel 246 and the outlet 248*a* of the nozzle channel 248 are substantially the same. In the exemplary example shown in FIG. 4B, a nozzle 204*b* has two nozzle channels 250 and 252. An outlet 250*a* of the nozzle channel 250 and an outlet 252*a* of the nozzle channel 252 are in elongated rectangular shapes. In addition, sizes of the outlet 250*a* of the nozzle channel 250 and the outlet 252*a* of the nozzle channel 252 are substantially the same.

Figure 4C:
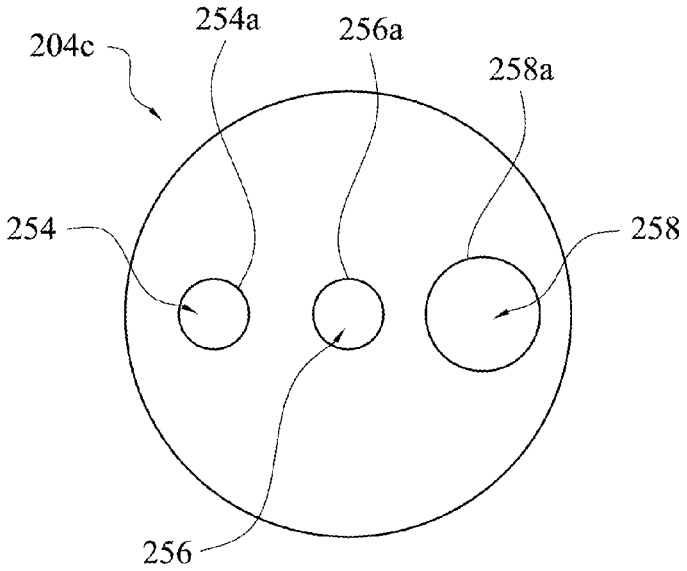
FIG. 4C is schematic drawing of outlets of a nozzle of an arc atmospheric pressure plasma device in accordance with a third embodiment of the present invention.

In the exemplary example shown in FIG. 4C, a nozzle 204*c* has three nozzle channels 254, 256 and 258. An outlet 254*a* of the nozzle channel 254, an outlet 256*a* of the nozzle channel 256 and an outlet 258*a* of the nozzle channel 258 are in circle shapes. In addition, sizes of the outlet 254*a* of the nozzle channel 254 and the outlet 256*a* of the nozzle channel 256 are substantially the same, and a size of the outlet 258*a* of the nozzle channel 258 are greater than those of the outlet 254*a* of the nozzle channel 254 and the outlet 256*a* of the nozzle channel 256. The nozzle channels 254, 256 and 258 are arranged in line.

Figure 4D:
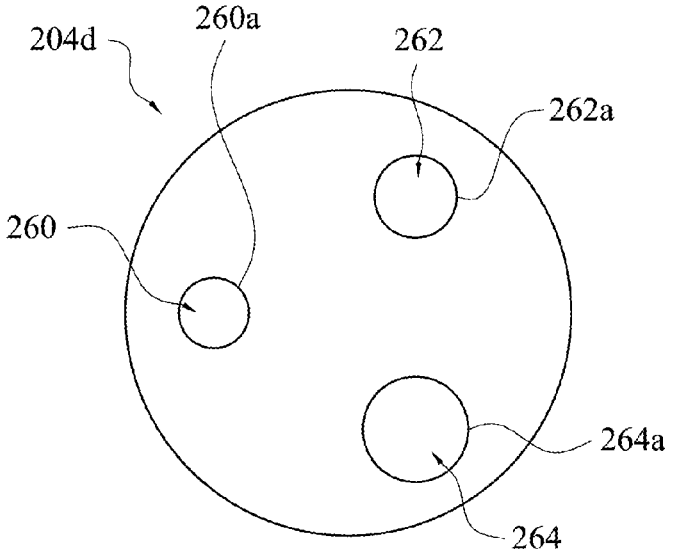
FIG. 4D is schematic drawing of outlets of a nozzle of an arc atmospheric pressure plasma device in accordance with a fourth embodiment of the present invention.

In the exemplary example shown in FIG. 4D, a nozzle 204*d* similarly has three nozzle channels 260, 262 and 264. An outlet 260*a* of the nozzle channel 260, an outlet 262*a* of the nozzle channel 262 and an outlet 264*a* of the nozzle channel 264 are in circle shapes. In addition, a size of the outlet 264*a* of the nozzle channel 264 is greater than a size of the outlet 262*a* of the nozzle channel 262, and the size of the outlet 262*a* of the nozzle channel 262 is greater than a size of the outlet 260*a* of the nozzle channel 260. The nozzle channels 260, 262 and 264 are distributed in the nozzle 204*d* and are not arranged in line.

According to the aforementioned embodiments, one advantage of the present invention is that an arc atmospheric pressure plasma device of the present invention has at least two nozzle channels, such that an amount of the ejected plasma in increased, and a treatment path of the plasma is denser. Thus, a treatment area of a plasma scanning operation can be increased, thereby effectively improving uniformity of treatment compared to a rotation nozzle with one single nozzle channel.

According to the aforementioned embodiments, another advantage of the present invention is that in an arc atmospheric pressure plasma device of the present invention, the nozzle with a multi-channel design blocks the arc and only plasma is ejected from the nozzle, thereby preventing a treated surface from be damaged due to a direct hit of the arc, so as to enhance uniformity and quality of the plasma treatment.

Although the present invention has been described in considerable detail with reference to certain embodiments thereof, the foregoing embodiments of the present invention are illustrative of the present invention rather than limiting of the present invention. It will be apparent to those having ordinary skill in the art that various modifications and variations can be made to the present invention without departing from the scope or spirit of the invention. Therefore, the spirit and scope of the appended claims should not be limited to the description of the embodiments contained herein.

What is claimed is:

1. An arc atmospheric pressure plasma device, comprising:
   - a first electrode configured to connect to a power supply;
   - a second electrode having a chamber and being grounded, wherein the first electrode is located within the chamber; and
   - a nozzle connected to a bottom of the second electrode, and having at least two nozzle channels, wherein the nozzle channels communicate with the chamber.

2. The arc atmospheric pressure plasma device of claim 1, wherein a central axis of each of the nozzle channels is parallel to a central axis of the chamber.

3. The arc atmospheric pressure plasma device of claim 1, wherein an included angle is formed between a central axis of each of the nozzle channels and a central axis of the chamber.

4. The arc atmospheric pressure plasma device of claim 1, wherein a central axis of at least one of the nozzle channels is parallel to a central axis of the chamber, and an included angle is formed between a central axis of at least the other one of the nozzle channels and the central axis of the chamber.

5. The arc atmospheric pressure plasma device of claim 1, wherein an outlet of each of the nozzle channels is in a circle shape, an ellipse shape, a slit shape or a polygon shape.

6. The arc atmospheric pressure plasma device of claim 1, wherein the second electrode is a rotation electrode which rotates by using a central axis of the chamber as a rotation axis.

7. The arc atmospheric pressure plasma device of claim 1, wherein a material of the nozzle is metal or a combination of metal and ceramics.

8. The arc atmospheric pressure plasma device of claim 1, wherein sizes of the nozzle channels are different.

9. The arc atmospheric pressure plasma device of claim 1, wherein sizes of the nozzle channels are substantially the same.

10. The arc atmospheric pressure plasma device of claim 1, wherein an output frequency of the power supply ranges from 1 kHz to 60 kHz, and a voltage of the power supply ranges from 5 kV to 20 kV.

* * * * *